United States Patent [19]

Kitterman

[11] Patent Number: 4,941,592

[45] Date of Patent: Jul. 17, 1990

[54] HINGED DISPENSING CLOSURE WITH A TAMPER-EVIDENT SEAL

[75] Inventor: Lawrence R. Kitterman, Antioch, Ill.

[73] Assignee: Seaquist Closures, Crystal Lake, Ill.

[21] Appl. No.: 367,868

[22] Filed: Jun. 19, 1989

[51] Int. Cl.[5] ..... B67D 5/06

[52] U.S. Cl. ..... 222/23; 222/153; 222/541; 222/556; 215/241; 215/250; 215/253; 215/258

[58] Field of Search ..... 222/23, 153, 541, 556; 215/241, 245, 250, 253, 258

[56] References Cited

U.S. PATENT DOCUMENTS

| | | | |
|---|---|---|---|
| 3,966,080 | 6/1976 | Bittel | 222/541 X |
| 4,127,221 | 11/1978 | Vere | 222/153 |
| 4,231,486 | 11/1980 | Bock | 215/250 X |
| 4,244,495 | 1/1981 | Lorscheid et al. | 222/153 |
| 4,361,250 | 11/1982 | Foster | 222/541 X |
| 4,602,718 | 7/1986 | Dutt | 215/253 X |
| 4,610,371 | 9/1986 | Karkiewicz | 222/153 X |
| 4,711,372 | 12/1987 | Gach | 222/153 X |
| 4,778,072 | 10/1988 | Newman | 222/153 X |
| 4,852,770 | 8/1989 | Sledge et al. | 222/153 |

*Primary Examiner*—Joseph J. Rolla
*Assistant Examiner*—Gregory L. Huson
*Attorney, Agent, or Firm*—Dressler, Goldsmith, Shore, Sutker & Milnamow, Ltd.

[57] ABSTRACT

A plastic molded tamper-evident dispensing closure with a tamper-evident seal. The seal is integrally molded with the closure lid and projects downwardly from a peripheral edge of the lid into interlocking engagement with the body. A seal segment is disposed in a peripheral notch in the lid to evidence access to the contents of an associated container.

7 Claims, 2 Drawing Sheets

FIG. 1
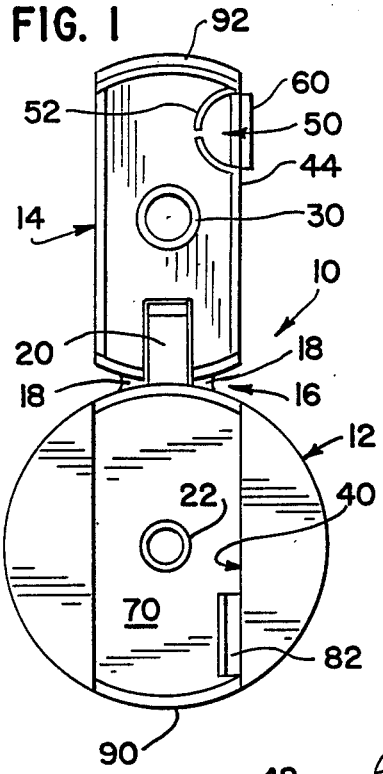
FIG. 2
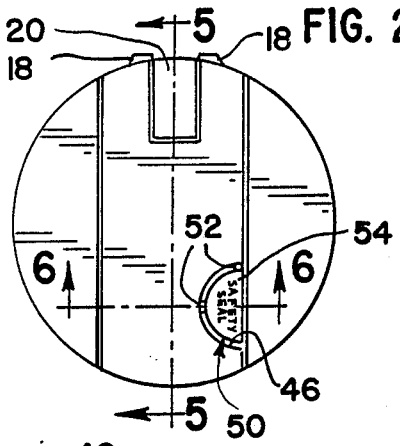
FIG. 4
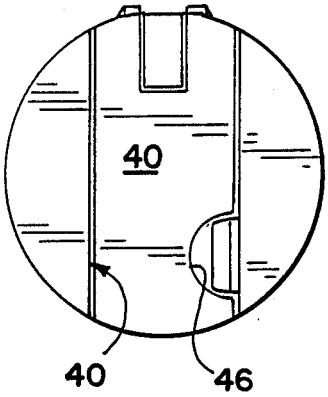
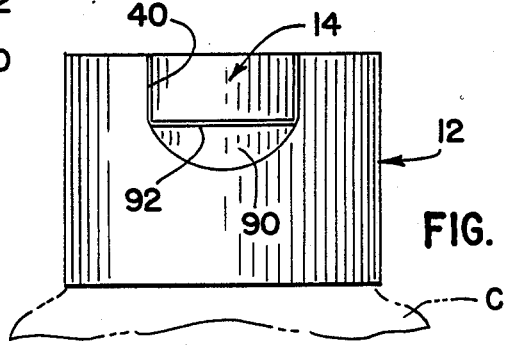
FIG. 3
FIG. 5
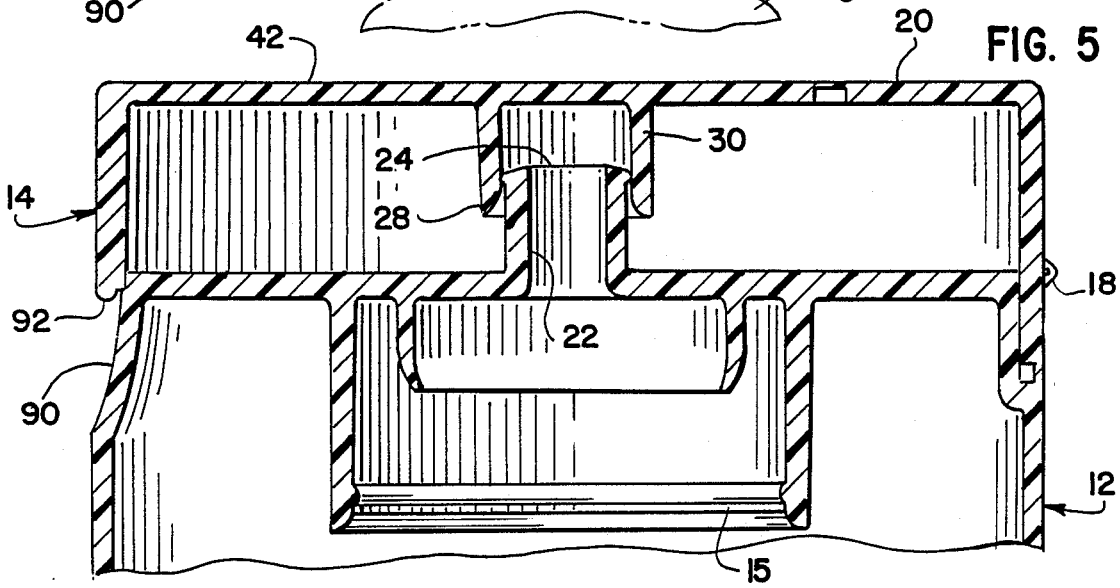
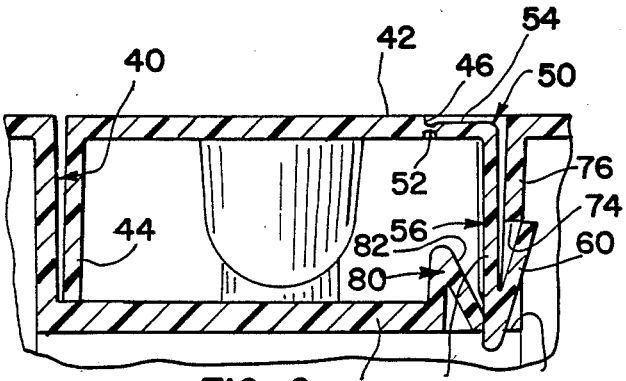
FIG. 6
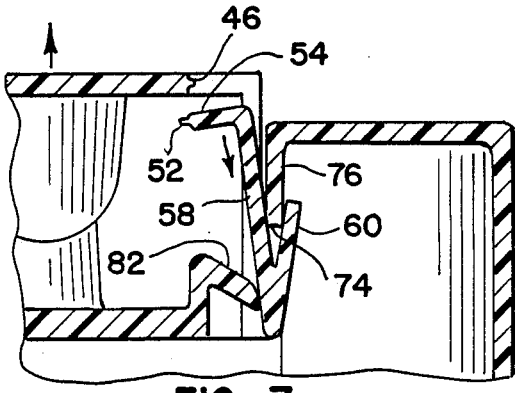
FIG. 7

FIG 8
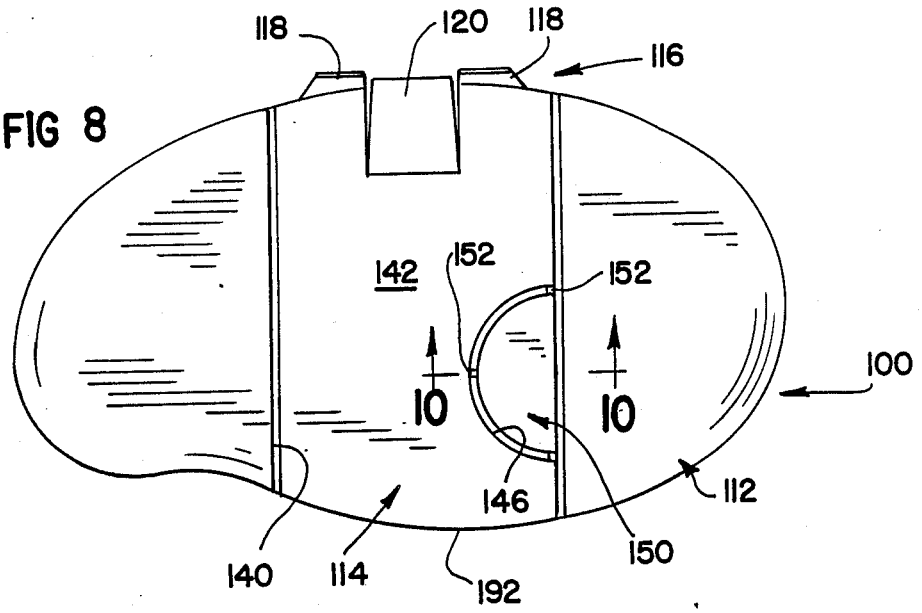
FIG. 9
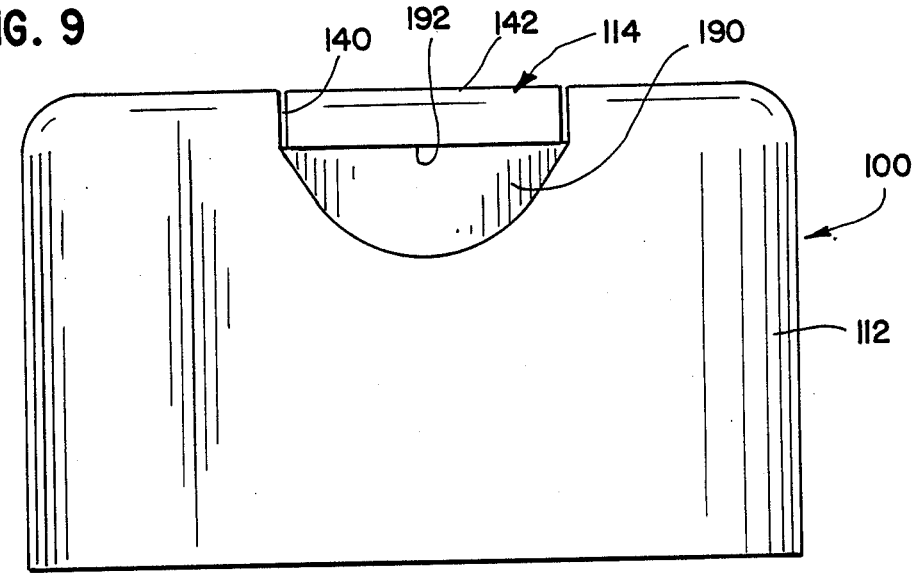
FIG. 10
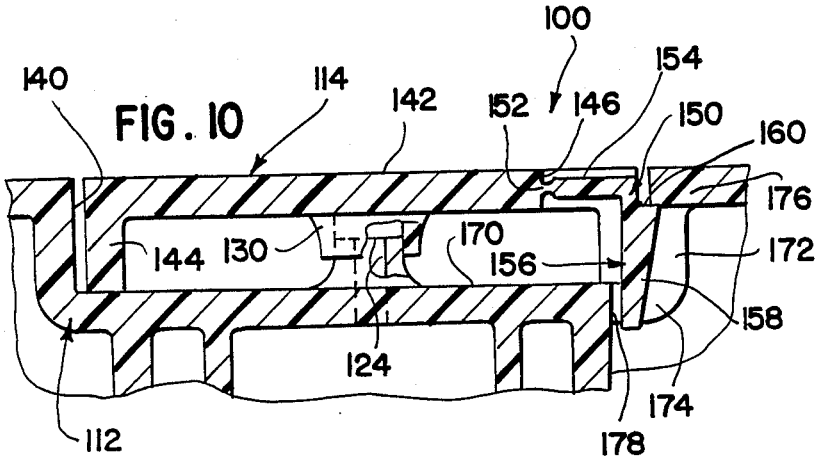
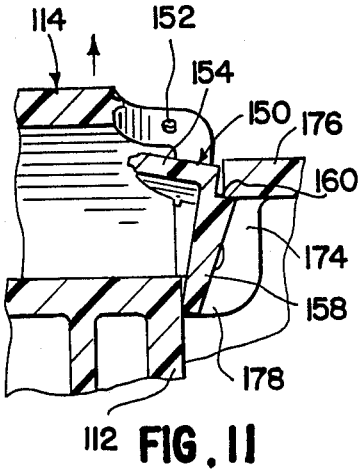
FIG. 11

HINGED DISPENSING CLOSURE WITH A TAMPER-EVIDENT SEAL

BACKGROUND OF THE INVENTION

With continuing threats by fringe elements of society to the safety of others, an increased concern has developed for assuring consumers that the products they purchase have not been tampered with. Thus, a considerable variety of techniques are used to let consumers know that no one has gained access to the contents of a package to be purchased.

Many products are sold with hinged dispensing closures which make use of the container contents easy and convenient. Although security may be provided with, for example, heat shrunk bands and by other techniques, it would be desirable to provide such security by an integrally formed security member which does not otherwise alter the closure, which does not detract from its aesthetics, and which does not significantly complicate or make difficult the initial use of the container.

Although a variety of products with similar attributes have been suggested, there remains the need for an improved tamper-evident dispensing closure with those and other advantages.

SUMMARY OF THE INVENTION

In accordance with the present invention a plastic molded tamper-evident dispersing closure comprising a body with means for securance to a container and a lid hingedly secured to the body and movable from a closed non-dispensing position to an open dispensing position on the body, the body further defining a dispensing opening, is provided. A tamper-evident seal means is integrally formed with the lid and is interlocked with the body in the closed non-dispensing position.

The seal means comprises a seal segment frangibly connected to the lid, and which is readily visible to a user of the closure. Frangible means connect the seal segment and the lid. An integral depending locking section extends downwardly from the seal segment, the locking section including a locking step extending laterally from the locking section. The body defines recess means below the seal segment and adjacent the locking step, and includes a first body portion. The locking step extends laterally into the recess with the first body portion overlying the locking step for engagement with the locking step to prevent movement of the lid from the closed position. The body provides a second portion opposite the first body portion and confronting the locking section for maintaining the locking step beneath the overlying first body portion. As such the lid may not be moved from the closed non-dispensing position without severing the frangible means to separate the seal means from the lid.

Desirably the second body portion comprises a cam means on the body opposite the recess means which engages the locking section and which urges the locking step into the recess means to underlie the first body portion, and the cam means preferably includes spring means for resiliently urging the locking step into the recess means to underlie the first body portion.

The body may define a lid receiving upper recess in which the lid is disposed in the closed non-dispensing position. The lid defines a notch in which the seal segment is disposed. Preferably the notch is in the upper surface of the lid and the seal segment is disposed in the notch. In its most preferred form the notch is positioned at a peripheral edge of the lid upper surface, and the seal segment lies at the peripheral edge of the lid confronting the lid receiving upper recess. The body upper recess may include a deck defining an opening below the seal segment and adjacent to the recess means with the locking section extending downwardly, into the opening and beneath the deck.

Further objects, features and advantages of the present invention will become apparent from the following description and drawings.

BRIEF DESCRIPTION OF THE DRAWINGS

FIG. 1 is a plan view of a dispensing closure of the present invention in an open dispensing position;

FIG. 2 is a plan view of the closure of FIG. 1 in a closed non-dispensing position;

FIG. 3 is a front view of the closure of FIG. 2 secured to a container;

FIG. 4 is a view like FIG. 2, but with the tamper-evident security seal removed;

FIG. 5 is a cross-sectional view taken substantially along line 5—5 of FIG. 2;

FIG. 6 is a view taken generally along line 6—6 of FIG. 2;

FIG. 7 is a view like FIG. 6, but with the security seal severed;

FIG. 8 is a plan view of a further dispensing closure embodiment of the present invention in a closed, non-dispensing position;

FIG. 9 is a front view of the closure of FIG. 8;

FIG. 10 is a cross-sectional view taken along line 10—10 of FIG. 8; and FIG. 11 is a fragmentary view like FIG. 10, but with the security seal severed.

DETAILED DESCRIPTION OF PRESENTLY PREFERRED EMBODIMENTS

Referring first to the drawings, and in particular to FIGS. 1–7, a dispensing closure 10 in accordance with the present invention is shown to comprise a body 12 adapted to be secured to a container C and a lid 14. Lid 14 is hingedly secured to the body 12, as by a well-known over-center hinge structure 16 comprising hinges 18 and a strap 20. The body is secured to the container C as by a locking flange 15 (FIG. 5).

Body 12 defines a discharge means including a discharge passage 22 and a dispensing orifice 24. To prevent inadvertent leakage through discharge opening, the closure lid provides a sealing means, such as a sealing sleeve 30.

So far dispensing closure 10 is generally similar in its principle of operation and construction to those available for some years now.

In accordance with the present invention an improved tamper-evident construction is provided for the integrally formed, hinged dispensing closure 10. To that end the lid 14 is locked to the body 12 via a frangible security member which, until it is removed, provides an assurance of security and, after it is removed, provides immediate evidence that access to the contents of the associated container has been available to others.

In the embodiment of FIGS. 1–7 the lid 14 is of a width less than that of body 12. Thus, the lid 14 is received, in its closed position, in a complementary body recess means such as body recess 40, thereby to provide a generally flat upper closure surface in the closed position. The upper surface of the lid may be generally co-planar with the upper surface. Thus lid 14 comprises an upper lid surface 42, as well as a depending peripheral wall 44.

The upper lid surface 42 also defines a peripheral notch 46. Notch 46 is initially provided with a security seal or locking post 50 integrally formed with the lid, as by being formed with the upper surface 42 and connected by multiple frangible webs 52. Locking post 50 not only comprises a seal or upper post portion 54 which lies within notch 46, but with a depending lock section 56. Lock section 56 comprises a depending leg 58 which may lie in a co-planar relationship with the adjacent portions of wall 44 and a locking step 60. Locking step 60 extends laterally outwardly relative to the lid wall 44 and is adapted to mechanically interengage and lock with a mating portion of the body 12.

Referring now to FIGS. 5–7 especially, the body recess 40 is defined in part by a lower deck 70. One of the side walls 72 of the recess 40 defines a further recess or opening 74 through which the locking step 60 extends to underlie a body portion 76 which body portion overlies the opening 74. When locking step 60 is so positioned, lifting of the lid 14 relative to the body to expose the discharge orifice is simply not possible without severing the frangible webs 52.

As more particularly shown in FIGS. 5–7, the opening 74 is adjacent to a further opening 78 in the lower deck 70. These openings may merge. Thus the locking post extends downwardly into opening 78 as clearly seen in FIG. 6. Additionally, to assure that the lock section 56 is thrust laterally outwardly to underlie the body portion 76, the lower deck section adjacent the openings 74, 78 is configured to cam the locking post outwardly. A cam, such as a spring biasing cam 80 is provided with a cam surface 82, and with an inverted V-shaped spring configuration which retains sufficient resiliency to continue to urge the locking post 50 and locking step 60 outwardly to interlock with the body 12, i.e., to provide a positive mechanical interlock between the seal and the body, until the locking post is removed as illustrated by FIG. 7. Further, as may be seen in FIG. 6, and as will be seen in FIGS. 10 and 11, the leg 58 extends below the surface of a portion of deck 70. As such, if the lid 14 shifts laterally the step is always maintained in its position underlying the body portion 76 to maintain the mechanical interlock.

The dispensing closure of FIGS. 1–7 is typically integrally molded, as of polypropylene, in the open condition of FIG. 1. After molding, the closure is moved from that open position, to the closed position represented by FIGS. 2, 3, 5 and 6. As the lid is swung on the body to the closed, non-dispensing position, the locking post 50 will be cammed inwardly along locking step 60 and the adjacent recess side wall 76 until the step 60 descends below body portion 76. At that time, the cam 80 will assure thrusting of the step 60 laterally to its position within the opening 74 for its secure interlocking relationship with body portion 76.

In the preferred form, body portion 76 overlies a V-shaped opening between the depending leg 58 and the locking step 60 to guarantee a firm interlocked relationship between the locking post, hence between the lid 14, and the body 12, thus to secure the closure against access to the container without clearly evidencing that access has been had.

To lift the lid 14, desirably the body 12 defines an indented portion 90 at its front and the lid defines a lift tab 92 extending forwardly of the upper zone of the indented portion 90.

As shown by FIG. 7, when the lid 14 is forced upwardly, or the locking post 50 is forced downwardly, as by a user pressing down on the seal or upper post portion 54 with sufficient force to sever the frangible webs 52, the locking lost 50 separates from the lid 14 and drops onto the deck or into the body to permit opening of the lid about the hinge structure 16. When the lid is then closed, as in FIG. 4, the notch 46 is open and clearly evidences that access has been gained to the container contents, i.e., the notch which is a sizeable opening will be visible on the upper surface of the lid member to the user indicating the closure has been opened.

It will be apparent that the closure of FIGS. 1–7 has a number of advantages. One is that the added tamper-evident feature does not alter the aesthetics of the closure because the tamper-evident feature does not project beyond the outside diameter or profile of the closure. For the same reasons, the closure does not impose any special or different capping requirements. No special bottle details or modifications are required to employ the tamper-evident features of the present invention. Where desired, the tamper-evident seal is retained in the closure body, until the consumer removes it if he wishes to do so. The tamper-evident feature itself provides the positive mechanical interlock between the closure body and the lid. As a supplemental feature, the tamper-evident seal may be used as a proof of purchase means for premiums and the like. The closure of FIGS. 8–11 has the same advantages.

Referring now to the embodiment of FIGS. 8–11, a further dispensing closure 100 in accordance with the present invention is shown to comprise a body 112 adapted to be secured to a container C, and a lid 114. Lid 114 is hingedly secured to the body 112, as by an over-center hinge structure 116 comprising hinges 118 and a strap 120. The body 112 is secured to the container as in the manner shown in FIG. 5.

Body 112 defines a discharge means including a discharge opening 124. To prevent inadvertent leakage through the discharge opening, the lid 114 provides a sealing means, such as a sealing sleeve 130.

So far dispensing closure 100 is generally similar in its principles of operation and construction to those available for some years now.

As seen, lid 114 is of a width less than that of body 112. Thus, the lid 114 is received, in its closed position, in a complementary body recess 140, thereby to provide a generally flat upper closure surface in the closed position. The upper surface of the lid may be generally co-planar with that of the body. Lid 114 may comprise an upper lid surface 142, as well as a depending peripheral wall 144.

In accordance with the present invention an improved tamper-evident construction is provided. To that end the lid 114 is locked to the body 112 via a frangible security member similar in function to that of locking post 50.

The upper lid surface 142 also defines a peripheral notch 146. Notch 146 is initially provided with a security seal or locking post 150 integrally formed with the lid, as by being formed with the upper surface 142 and connected by multiple frangible webs 152. Locking post 150 not only comprises a seal or upper post portion 154 which lies within notch 146, but has a depending lock section 156 as well. Lock section 156 comprises a depending leg 158 a locking step 160. Locking step 160 extends laterally outwardly relative to the lid wall 144 and is adapted to mechanically interengage and lock with a mating portion of the body 112.

The recess 140 defined by the body 112 defines a lower deck 170. One of the side walls 172 of the recess 140 defines a further recess or opening 174 through which the locking step 160 extends to underlie a body portion 176, which body portion overlies the opening 174. When locking step 160 is so positioned, lifting of the lid 114 relative to the body 112 to expose the discharge opening 124 is not possible without severing the frangible webs 152.

The opening 174 is adjacent to a further opening 178 in the lower deck 170. These openings may merge. Thus the locking post extends downwardly into opening 178. Additionally, to assure that the lock section 156 is positioned to underlie the body portion 176, the lower deck section adjacent the openings 174, 178 and opposite portion 176 is configured to maintain the locking step 160 in an outward position which remains interlocked with the body portion 176, thereby to provide a positive mechanical interlock between the seal and the body, until the locking post is removed as illustrated by FIG. 11.

The dispensing closure of FIGS. 8–11 is typically integrally molded, as of polypropylene, in an open position. After molding, the closure is moved from that open position, to the closed position represented by FIGS. 8–11. As the lid is swung on the body to the closed, non-dispensing position, the locking post 150 will be thrust downwardly along locking step 160 and the adjacent recess side wall 176 until the step 160 descends below body portion 176. At that time, the step 160 will spring laterally to its position within the opening 174 for its secure interlocking relationship with body portion 176. To guarantee a firm interlocked relationship between the locking post, hence between the lid 114, and the body 112, thus to secure the closure against access to the container without clearly evidencing that access has been had, the deck 170 is preferably, spaced from the leg 158 by a distance such that movement of leg 158 towards the deck will be stopped before the locking step 160 moves out of its position beneath body portion 176. If the leg 156 should cant to the left (as seen in FIG. 10), the deck portion 170 will stop its movement before the step 160 moves away from its underlying relationship to body portion 176. Further, as may be seen in FIG. 6, and as will be seen in FIGS. 10 and 11, the leg 158 extends below the surface of a portion of deck 170. As such, if the lid 114 shifts laterally the step 160 is always maintained in its position underlying the body portion 176 to maintain the mechanical interlock.

To lift the lid 114, the body 112 defines an indented portion 190 at its front and the lid defines a lift tab 192 extending forwardly of the upper zone of the indented portion 190.

As shown by FIG. 11, when the lid 114 is forced upwardly, or the locking post 150 is forced downwardly, as by a user pressing down on the seal or upper post portion 154 with sufficient force to sever the frangible webs 152, the locking post 150 separates from the lid 114 and drops onto the deck or into the body to permit opening of the lid about the hinge structure 116. When the lid is then closed, the notch 146 is open and clearly evidences that access has been gained to the container contents, i e., the notch which is a sizeable opening is visible on the top surface of the lid member to the user indicating the closure has been opened.

It will be apparent to those skilled in the art that modifications may be made without departing from the spirit and scope of the invention. Accordingly, it is intended that the invention not be limited to the illustrated embodiments, but only as may be necessary in accordance with the appended claims.

What is claimed is:

1. A plastic molded tamper-evident dispensing closure comprising a body with means for securance to a container and a lid hingedly secured to said body and movable from a closed non-dispensing position to an open dispensing position on said body, said body further defining a dispensing opening, tamper-evident seal means integrally formed with said lid and interlocked with said body in said closed non-dispensing position, said seal means comprising a seal segment frangibly connected to said lid and which is readily visible to a user of the closure, frangible means connecting said seal segment and said lid, and an integral depending locking section extending downwardly from said seal segment, said locking section including a locking step extending laterally from said locking section, said body defining recess means below said seal segment and adjacent said locking step and including a first body portion, said locking step extending laterally into said recess with said first body portion overlying said locking step for engagement with said locking step to prevent movement of said lid from said closed position, and said body providing a second portion opposite said overlying first body portion and confronting said locking section for maintaining said locking step beneath said overlying first body portion, whereby said lid may not be moved from said closed non-dispensing position without severing said frangible means to separate said seal means from said lid.

2. The dispensing closure of claim 1, and wherein said second body portion comprises cam means on said body opposite said recess means engaging said locking section and urging said locking step into said recess means to underlie said first body portion.

3. The dispensing closure of claim 2, and wherein said cam means include spring means for resiliently urging said locking step into said recess means to underlie said first body portion.

4. The dispensing closure of claim 1, and wherein said body defines a lid receiving upper recess in which said lid is disposed in said closed non-dispensing position, and wherein said lid defines a notch in which said seal segment is disposed.

5. The dispensing closure of claim 4, and wherein said body upper recess includes a deck defining an opening below the seal segment and adjacent to said recess means, and wherein said locking section extends downwardly into said opening and beneath said deck.

6. The dispensing closure of claim 4, and wherein said notch is in the upper surface of the lid and said seal segment is disposed in said notch.

7. The dispensing closure of claim 6, and wherein said notch is positioned at a peripheral edge of the lid upper surface, and said seal segment lies at the peripheral edge of said lid confronting the lid receiving upper recess.

* * * * *